US006545433B2

(12) United States Patent
Beij et al.

(10) Patent No.: US 6,545,433 B2
(45) Date of Patent: Apr. 8, 2003

(54) CIRCUIT ARRANGEMENT EQUIPPED WITH A TIMER COMPENSATING LAMP DEGRADATION THROUGH ITS SERVICE LIFE

(75) Inventors: Marcel Beij, Eindhoven (NL); Arnold Willem Buij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/144,822

(22) Filed: Oct. 25, 2001

(65) Prior Publication Data

US 2002/0185980 A1 Dec. 12, 2002

(30) Foreign Application Priority Data

Oct. 27, 2000 (EP) ..... 00203796

(51) Int. Cl.[7] ..... G05F 1/00

(52) U.S. Cl. ..... 315/291; 315/360; 315/224; 315/307

(58) Field of Search ..... 315/291, 360, 315/307, 224, 225, 246

(56) References Cited

U.S. PATENT DOCUMENTS

| | | | | | |
|---|---|---|---|---|---|
| 5,075,599 | A | * | 12/1991 | Overgoor et al. | 315/224 |
| 6,051,935 | A | * | 4/2000 | Bucks et al. | 315/224 |
| 6,051,939 | A | * | 4/2000 | Eckert | 315/307 |
| 6,177,768 | B1 | * | 1/2001 | Kamata et al. | 315/241 R |
| 6,207,943 | B1 | * | 3/2001 | Smelker | 250/205 |

* cited by examiner

*Primary Examiner*—Don Wong
*Assistant Examiner*—Tuyet T. Vo

(57) ABSTRACT

A ballast circuit for operating a discharge lamp is equipped with a timer for measuring the service life of the lamps, and with means for increasing the power supplied to the lamp as the number of burning hours increase. The decrease in efficiency associated with the increase in burning hours is compensated thereby.

4 Claims, 2 Drawing Sheets

CIRCUIT ARRANGEMENT EQUIPPED WITH A TIMER COMPENSATING LAMP DEGRADATION THROUGH ITS SERVICE LIFE

The invention relates to a circuit arrangement for energizing a lamp, comprising input terminals which are to be connected to a supply voltage source, a first circuit part I coupled to the input terminals for generating a current through the lamp from a supply voltage supplied by the supply voltage source, a second circuit part II coupled to the first circuit part I for setting the power consumed by the lamp to a desired value.

BACKGROUND OF THE INVENTION

Such a circuit arrangement is disclosed in EP 0430357. In the known circuit arrangement, the power consumed by the lamp is regulated by measuring the actual lamp power and comparing this with the desired value. The result of this comparison is used to influence the operating condition of the first circuit part I in such a manner that the actual power consumed by the lamp is continuously substantially equal to the desired value of the lamp power. Viewed over a small number of operating hours of the lamp, such a substantially constant value of the power consumed by the lamp also means that the luminous flux of the lamp is substantially constant. However, viewed over a comparatively large number of operating hours, the luminous flux of the lamp decreases, at a constant lamp power, as a result of aging of the lamp. Apart from said decrease of the luminous flux as a result of aging of the lamp, the overall quantity of light may also decrease as a result of, for example, fouling of the luminaire accommodating the lamp. Often, such a reduction of the total quantity of light is taken into account in that the desired value of the power consumed by the lamp is set to a comparatively high value. As a result, although the quantity of light emitted by the lamp has decreased after a comparatively large number of burning hours, it still meets the requirements imposed, for example, for safety reasons. A drawback of dealing with the problem in such a way resides in that, during this comparatively large number of burning hours, the power consumption of the lamp is higher than would be necessary to generate a quantity light that satisfies the prevailing safety requirements. As a result, the operation of the lamp using the known circuit arrangement is comparatively inefficient.

THE SUMMARY OF THE INVENTION

It is an object of the invention to provide a circuit arrangement which enables a lamp to generate a quantity of light, throughout its service life, which satisfies the requirements to be imposed, while the lamp operates comparatively efficiently throughout the service life.

To achieve this, a circuit arrangement of the type mentioned in the opening paragraph is characterized in accordance with the invention in that the second circuit part comprises a timer for measuring the total number of burning hours of the lamp, and a third circuit part III, coupled to said timer, for setting the power consumption of the lamp at the desired value in dependence upon the number of burning hours of the lamp.

In the course of the service life of the lamp, the third circuit part III increases the desired value of the power consumed by the lamp. As a result, the reduction of the amount of light generated due to aging and fouling is at least partly compensated for. If a circuit arrangement in accordance with the invention is used, the desired value of the power consumed by the lamp can be set, immediately after the lamp has come into operation (i.e. after zero burning hours), at a value such that the amount of light supplied by the lamp is sufficient, yet not much larger, to satisfy, for example, safety requirements. Before the amount of light supplied by the lamp decreases as a result of aging and fouling to a level below that required by safety requirements, the desired value of the power consumed by the lamp is increased by the third circuit part III. It is thus achieved that, throughout its service life, the lamp consumes approximately as much power as it needs to produce a desired/required amount of light. As a result, the lamp operates very efficiently. The increase of the desired value of the lamp power can take place continuously. Alternatively, such an increase can also take place in steps after a predetermined number of burning hours. In the latter case, said third circuit part advantageously comprises a memory for establishing a table that determines the relation between the overall number of burning hours and the desired value of the power consumed by the lamp. Said third circuit part also advantageously comprises a microprocessor enabling such a table to be read and the content of the timer to be monitored.

These and other aspects of the invention will be apparent from and elucidated with reference to the embodiment(s) described hereinafter.

DETAILED DESCRIPTION

Figure 1:
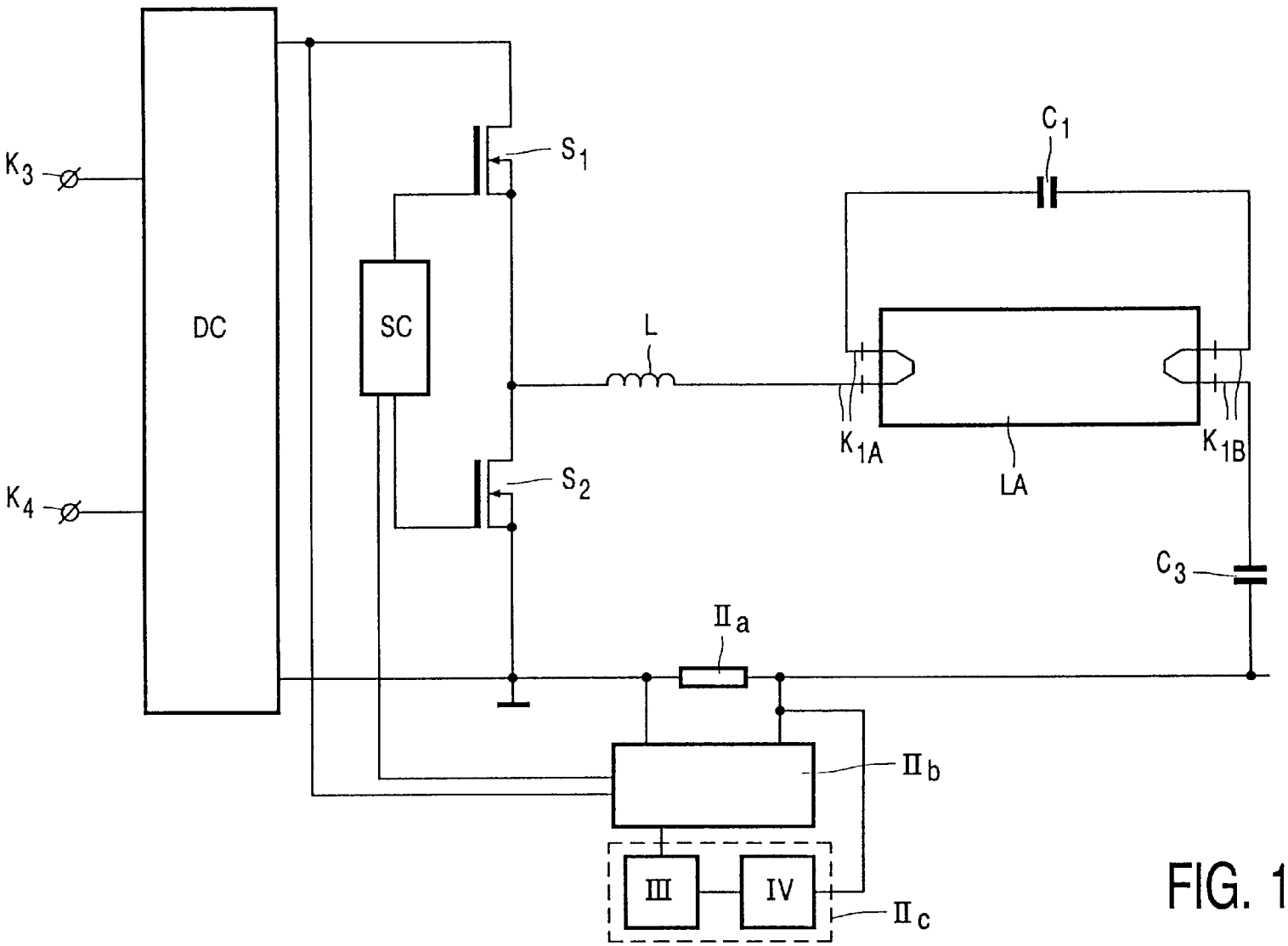
FIG. 1 shows an example of a circuit arrangement in accordance with the invention to which a lamp is connected.

In FIG. 1, K3 and K4 are input terminals which are to be connected to a supply voltage source. In the case of the example shown in FIG. 1, this supply voltage source supplies a low-frequency AC voltage. Input terminals K3 and K4 are connected to respective inputs of circuit part DC. Circuit part DC is a circuit part for generating a substantially constant DC voltage from a low-frequency AC voltage. A first output of the circuit part DC is connected to a second output by means of a series arrangement of a first switching element S1 and a second switching element S2. A control electrode of the first switching element S1 is coupled to a first output of circuit part SC. A control electrode of the second switching element S2 is coupled to a second output of circuit part SC. Circuit part SC is a control circuit for rendering the switching elements S1 and S2 alternately conducting and non-conducting.

Switching element S2 is shunted by a series arrangement of coil L, lamp terminal K1A, lamp LA, lamp terminal K1B, capacitor C3 and sensor IIa, which sensor is formed by an ohmic resistance. The lamp LA is shunted by capacitor C1. Coil L, lamp terminal K1A, lamp LA, lamp terminal K1B, capacitor C3, sensor IIa and capacitor C1 jointly form a load branch. Respective ends of sensor IIa are connected to a first input and a second input of circuit part IIb. A third input of circuit part IIb is connected to the first output of circuit part DC. An output of circuit part IIb is connected to an input of the circuit part SC. A junctionn point of sensor IIa and capacitor C3 is connected to an input of circuit part IV. Circuit part IV is a timer for measuring the total number of burning hours of the lamp. An output of circuit part IV is connected to an input of a third circuit part III for setting the power consumption of the lamp at the desired value in dependence upon the number of burning hours of the lamp. Circuit part IV and third circuit part III jointly form a circuit part IIc. Circuit part IIb, sensor IIa and circuit part IIc jointly form a circuit part II for setting the power consumed by the lamp at a desired value. All components and circuit parts of the example shown in FIG. 1, with the exception of the second circuit part II and the lamp LA, jointly form a first circuit part I for generating a current through the lamp from the low-frequency AC voltage supplied by the supply voltage source. In this example, the third circuit part III is formed by a microprocessor.

The operation of the example shown in FIG. 1 is as follows.

If the input terminals K3 and K4 are connected to a supply voltage source supplying a low-frequency AC voltage, the circuit part DC generates a substantially constant DC voltage from this low-frequency AC voltage, said DC voltage being present between the outputs of the circuit part DC. The circuit part SC renders the first switching element S1 and the second switching element S2 successively conducting and non-conducting at a frequency f. As a result, a substantially square-wave voltage of frequency f is present at a junction point of the switching elements. Under the influence of said substantially square-wave voltage, an alternating current of frequency f flows in the load branch. A voltage whose amplitude is proportional to the instantaneous amplitude of the current in the load branch is present between the first and the second input of the circuit part IIb. A signal that is a measure of the DC voltage generated by the circuit part DC is present on the third input of the circuit part IIb. By means of the signals present on the first, the second and the third input, the circuit part IIb generates a first signal that is a measure of the actual power consumed by the lamp. A second signal that is a measure of a desired value of the power consumed by the lamp is present on the output of the third circuit part III and hence on the fourth input of the circuit part IIb. The circuit part IIb compares the first signal with the second signal and influences, via the output of circuit part IIb and the input of circuit part SC, the frequency and/or the duty cycle with which the switching elements are rendered conducting and non-conducting, in such a manner that the actual power consumed by the lamp is substantially equal to the desired value. The timer formed by the circuit part IV counts the number of burning hours of the lamp LA as long as the voltage across sensor IIa indicates that the lamp LA is in operation. If the content of the timer has increased by a predetermined number of burning hours, then the microprocessor forming the third circuit part III increases its output signal to a predetermined value established in a table in a memory forming part of the microprocessor. This table determines the relation between the number of burning hours and the desired value of the power consumed by the lamp. It is thus achieved that, throughout its service life, the lamp generates an amount of light that meets the requirements and/or corresponds to the amount desired, yet does not substantially exceed said required or desired amount of light, so that the power consumption of the lamp, at any moment in time, is comparatively small.

Figure 2:
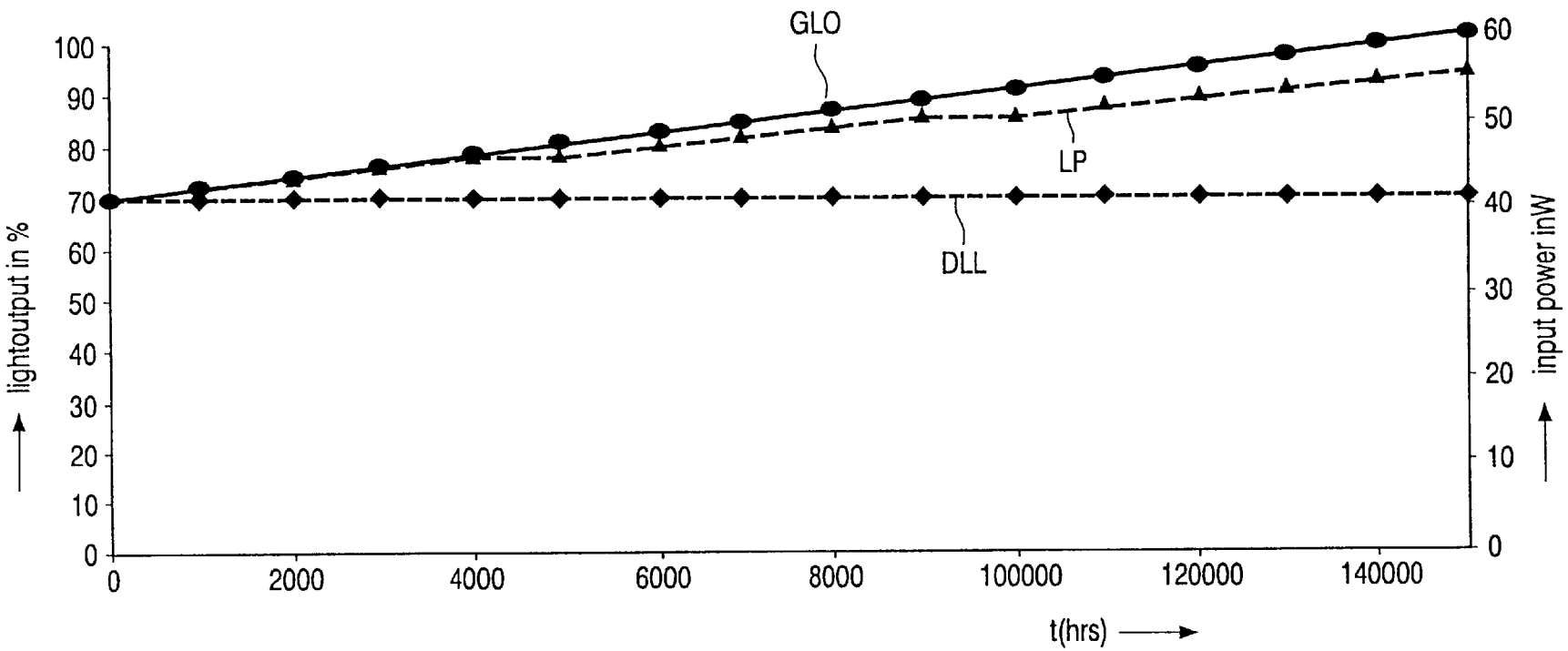
FIG. 2 shows the power consumed and the luminous flux of a lamp energized by means of the example shown in FIG. 1 as a function of the number of burning hours of the lamp.

In FIG. 2, the luminous flux of the lamp, expressed as a percentage of the maximum luminous flux of the lamp, is plotted along the left, vertical axis. The power consumed by the lamp, expressed in Watt, is plotted along the right, vertical axis. The number of burning hours, expressed in units of hours, is plotted along the horizontal axis. The curve GLO indicates the luminous flux of a low-pressure mercury discharge lamp having a rated power of 60 Watts as a function of the number of burning hours. This luminous flux is expressed as a percentage of the maximum luminous flux and increases as a function of the number of burning hours. This increase can be attributed to the fact that the maximum luminous flux of the lamp decreases as a result of aging. The curve LP shows the power supplied to the lamp as a function of the number of burning hours. The Figure also shows that this curve is an increasing function of the number of burning hours. The curve DLL shows both the desired amount of light and the actual amount of light emitted by a lamp energized by means of a circuit arrangement as shown in FIG. 1. The Figure shows that the curve DLL is a substantially horizontal line. Immediately after the lamp has been put into operation (i.e. after zero burning hours), the power consumed by the lamp is set at approximately 42 Watts. At this power, the lamp supplies 70% of the maximum luminous flux that the lamp can supply (at zero burning hours). After 15,000 burning hours, the power consumed by the lamp is 57 Watts, and the lamp supplies approximately the maximum luminous flux (i.e. that the lamp is capable of producing after 15,000 burning hours). The Figure shows that the average power consumed by the lamp is approximately 49.5 Watts. Since the maximum power consumed by the lamp is approximately 57 Watts, the measure in accordance with the invention enables a saving in energy to be achieved that is approximately equal to 15,000 hours*(57 Watts−49.5 Watts)=112.5 kilowatthour.

What is claimed is:

1. A circuit arrangement for energizing a lamp, comprising input terminals which are to be connected to a supply voltage source, a first circuit part I coupled to the input terminals for generating a current through the lamp from a supply voltage supplied by the supply voltage source, a second circuit part II coupled to the first circuit part I for setting the power consumed by the lamp at a desired value, characterized in that the second circuit part comprises a timer for measuring the total number of burning hours of the lamp, and a third circuit part III, coupled to said timer, for setting the power consumption of the lamp at desired value in dependence upon the number of burning hours of the lamp.

2. A circuit arrangement as claimed in claim 1, wherein the third circuit part increases the desired value of the power consumed by the lamp in a step-by-step manner after a predetermined number of burning hours of the lamp.

3. A circuit arrangement as claimed in claim 1, wherein the third circuit part comprises a microprocessor.

4. A circuit arrangement as claimed in claim 2, wherein the third circuit part comprises a memory for establishing a table that determines the relation between the total number of burning hours and the desired value of the power consumed by the lamp.

* * * * *